US005667411A

United States Patent [19]

O'Sullivan et al.

[11] Patent Number: 5,667,411

[45] Date of Patent: Sep. 16, 1997

[54] ELECTRICAL CONNECTOR HAVING TERMINAL ALIGNMENT MEANS

[75] Inventors: Michael O'Sullivan, Willowbrook; James A. Wetter, Hoffman Estates, both of Ill.

[73] Assignee: Molex Incorporated, Lisle, Ill.

[21] Appl. No.: 525,454

[22] Filed: Sep. 8, 1995

[51] Int. Cl.[6] ..... H01R 13/502

[52] U.S. Cl. ..... 439/701; 439/752.5

[58] Field of Search ..... 439/686, 701, 439/345–350, 357, 607, 610, 752.5

[56] References Cited

U.S. PATENT DOCUMENTS 5,073,127 12/1991 Daly et al. ..... 439/701 X 5,171,161 12/1992 Kachlic ..... 439/701 X 5,304,069 4/1994 Brunker et al. ..... 439/108

FOREIGN PATENT DOCUMENTS 7-220823 8/1995 Japan .

*Primary Examiner*—Khiem Nguyen

*Attorney, Agent, or Firm*—Charles S. Cohen

[57] ABSTRACT

An electrical connector includes a dielectric housing having a cavity for receiving a plurality of terminal modules. Each of the plurality of terminal modules includes a dielectric insert receivable in the cavity to define a side-by-side array of modules. Each insert is overmolded about a plurality of terminals to rigidly fix the terminals with male portions of the terminals projecting from the housing. Auxiliary alignment apertures are provided in the housing immediately adjacent the cavity for embracing and maintaining proper spacing and alignment of the male portions of the terminals.

7 Claims, 6 Drawing Sheets

ELECTRICAL CONNECTOR HAVING TERMINAL ALIGNMENT MEANS

FIELD OF THE INVENTION

This invention generally relates to the art of electrical connectors and, particularly, to an electrical connector which includes features for maintaining the alignment of a plurality of terminals.

BACKGROUND OF THE INVENTION

A known type of input/output (I/O) electrical connector includes a dielectric housing having a front mating face and a rear face with a terminal-receiving cavity extending therebetween. A plurality of terminals are mounted in the cavity, with portions of the terminals, such as male pin portions, extending from the cavity outwardly of the dielectric housing for mating with the terminals of a complementary mating connector. Most often, the terminals have enlarged body sections which are used to fix the terminals within the connector housing so that the projecting mating portions of the terminals are maintained in proper spacing and alignment.

In other connectors of this type, a plurality of terminal modules are insertable into the housing cavity, with each module including a dielectric insert or strip surrounding a plurality of the terminals. The dielectric insert may be overmolded about the body sections of the plurality of terminals. For instance, thin elongated terminal modules may be positioned in a side-by-side or "stacked" array within the housing cavity. In order to hold the modules within the cavity, various latch means are provided. In essence, the overmolded dielectric inserts function to properly space and align the projecting mating portions of the terminals.

Still further, many such I/O electrical connectors include separate tail aligning devices, such as a flat plastic member having apertures therethrough which function to maintain projecting tail portions of the terminals in proper spacing and alignment. A problem with separate aligning devices is that they add costs to the connector both in structure and in assembly procedures.

The present invention is directed to solving the problems encountered in properly spacing and aligning projecting portions of the terminals by employing an auxiliary alignment means directly on the connector housing. The auxiliary alignment means also is designed for accommodating terminals having twisted mating pin portions projecting from the connector.

SUMMARY OF THE INVENTION

An object, therefore, of the invention is to provide a new and improved electrical connector with auxiliary alignment means.

Another object of the invention is to provide an electrical connector of the character described wherein the alignment means is specially adapted for receiving twisted mating pin portions of the terminals.

In the exemplary embodiment of the invention, the electrical connector includes a dielectric housing having a cavity for receiving a plurality of terminal modules. Each of a plurality of terminal modules includes a dielectric insert receivable in the cavity to define a side-by-side array of modules. Each insert is overmolded about a plurality of terminals to rigidly fix the terminals with male portions of the terminals projecting from the housing. Generally, auxiliary alignment means are provided on the housing immediately adjacent the cavity for embracing and maintaining proper spacing and alignment of the male portions of the terminals.

More particularly, the auxiliary alignment means is integrally formed with the housing and comprise apertures in the housing communicating with the cavity. The apertures substantially surround the terminals and have opposing side walls for embracing opposite sides of the male portions of the terminal.

As disclosed herein, the male portion of each terminal includes an elongated blade engaged on opposite sides thereof by the opposing side walls of a respective one of the apertures. The blade terminates in a distal contact end twisted out of the plane of the blade. The respective aperture includes an oblique portion intersecting the opposite side walls for passage therethrough of the twisted distal contact end of the blade.

Other features of the invention include complementary interengaging positioning means between the inserts and the housing. Complementary interengaging latch means are provided on each insert of each terminal module for latching the modules in their side-by-side array.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
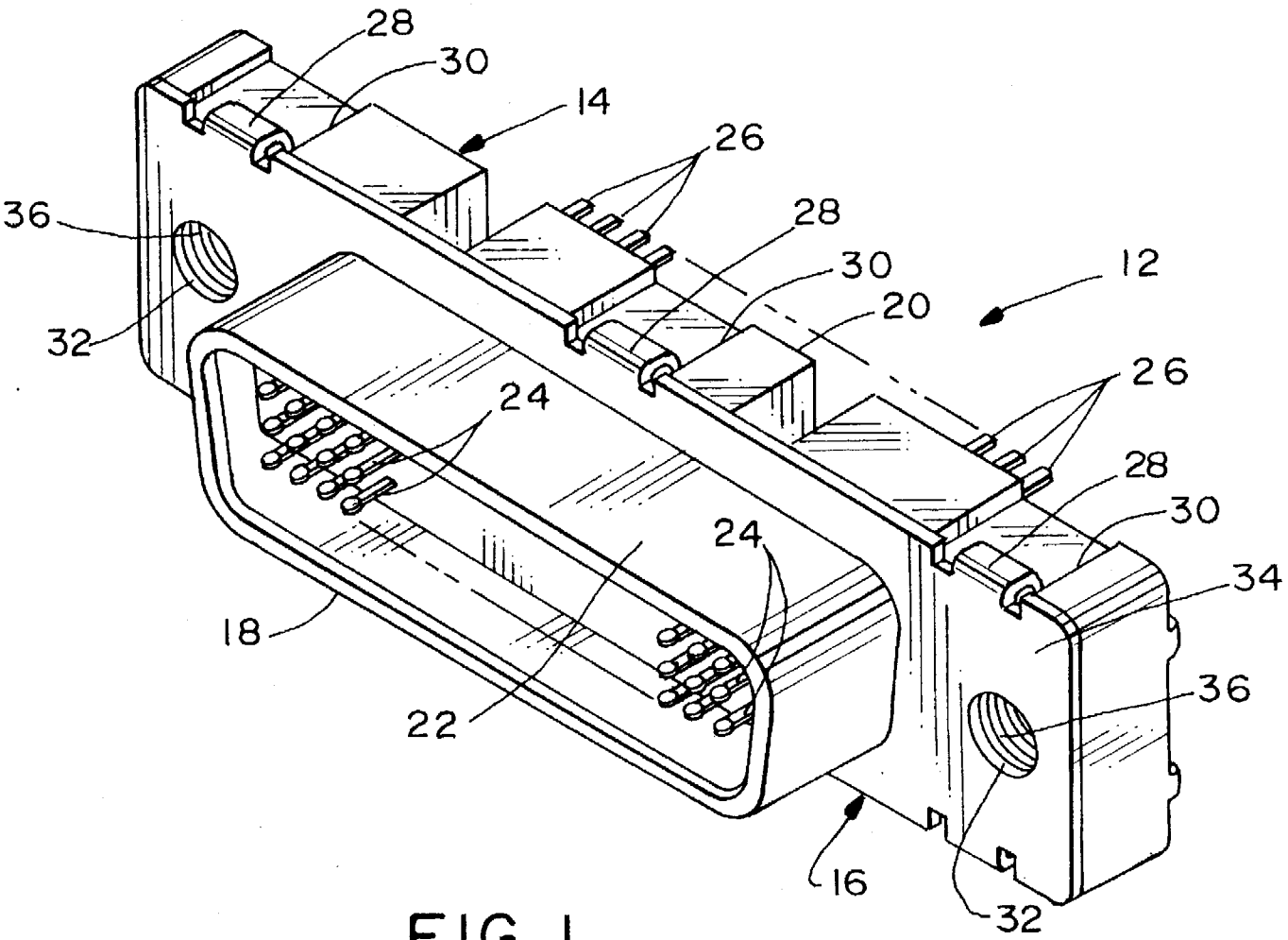
FIG. 1 is a perspective view of an electrical connector embodying the concepts of the invention.
Figure 3:
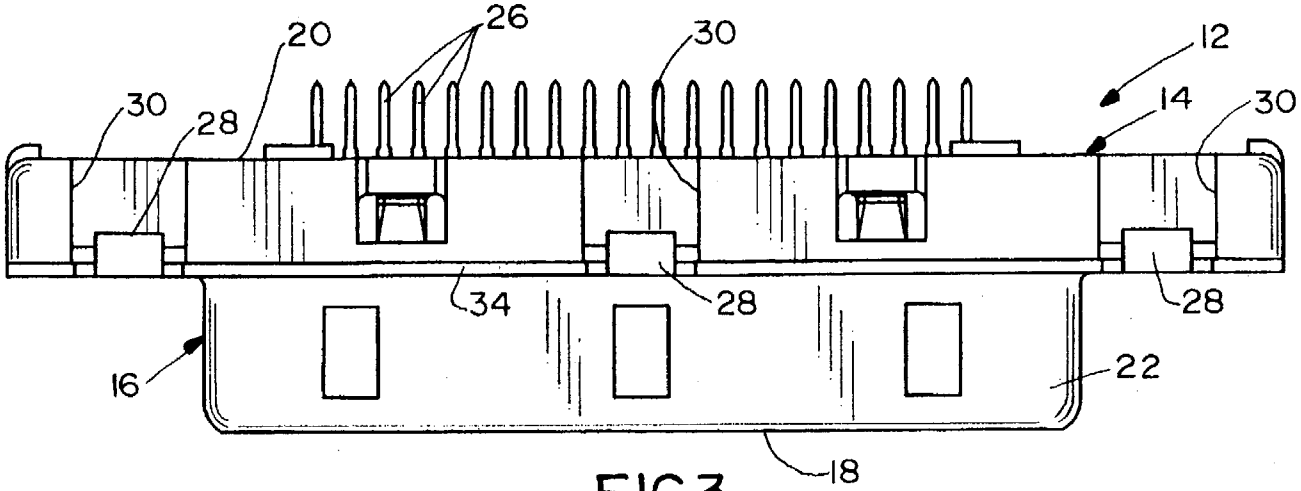
FIG. 3 is a top plan view of the connector.

Referring to the drawings in greater detail, and first to FIGS. 1–4, the invention is embodied in an electrical connector, generally designated 12, which includes an elongated dielectric housing, generally designated 14, and a front shield, generally designated 16. Housing 14 is a one-piece structure unitarily molded of dielectric material such as plastic or the like. Shield 16 is a one-piece structure stamped and formed of sheet metal material.

The connector is an input/output (I/O) electrical device wherein shield 16 defines a front mating face 18 of the connector, and housing 14 defines a rear terminating face 20. The front face actually is formed by a D-shaped shroud portion 22 of the shield surrounding forwardly projecting mating portions 24 of a plurality of terminals (described hereinafter) projecting forwardly of housing 14. Tail portions 26 of the terminals project from rear face 20 of the connector for insertion into appropriate holes in a printed circuit board for connection to circuit traces on the board and/or in the holes.

As best seen in FIG. 1, rearwardly formed tabs 28 of shield 16 embrace housing 14 within recesses 30 thereof. Lastly, holes 32 in a base plate 34 of shield 16 are aligned with internally threaded holes 36 in housing 14 for receiving appropriate threaded fasteners for fastening the connector to a printed circuit board and/or to a complementary mating connector.

Figure 4:
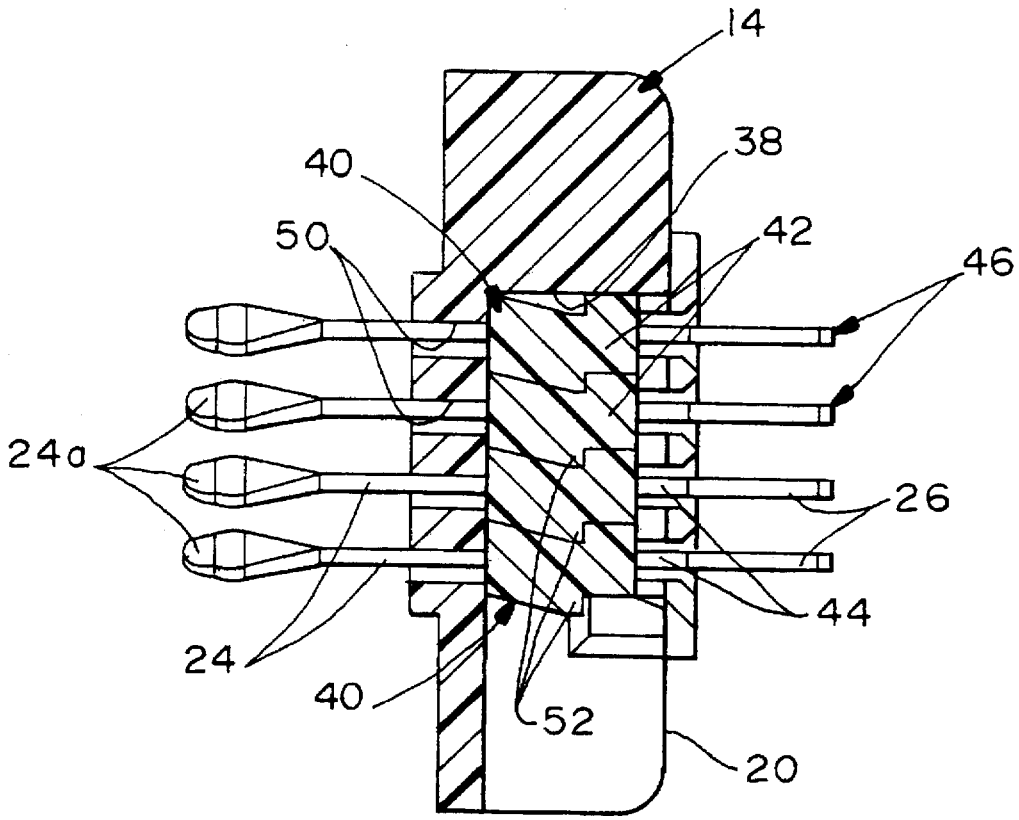
FIG. 4 is a vertical section generally along line 4—4 of FIG. 2 through the connector housing mounting a plurality of the terminal modules.
Figure 5:
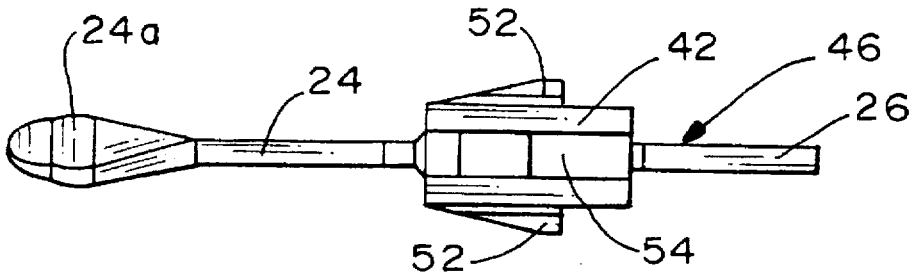
FIG. 5 is an end elevational view of one of the terminal modules.

Referring to FIG. 5 in conjunction with FIGS. 1–4 and particularly FIG. 4, housing 14 of connector 12 includes a longitudinal cavity 38 for receiving a plurality of terminal modules, generally designated 40, in a side-by-side array of modules within the cavity. Each module includes a one-piece longitudinal dielectric insert 42 which is overmolded about body or base sections 44 of a plurality of terminals, generally designated 46. Each terminal includes a blade-like forwardly projecting mating male portion 24 and a rearwardly projecting tail portion 26 extending from opposite sides of body section 44. As best seen in FIG. 4, mating portions 24 of the terminals extend into and through apertures or passages 50 in housing 14, and tail portions 26 project outwardly of housing cavity 38 beyond rear terminating face 20 of the connector. Lastly, as best seen in FIGS. 4 and 5, each terminal blade 24 terminates in a distal end **24*a*** that is twisted out of the plane of the blade.

Terminal modules 40 are interengaged in their side-by-side array within housing cavity 38. In particular, latch projections 52 project outwardly from the sides of the dielectric inserts 42 of the modules into complementary recesses in the opposite sides of the inserts of adjacent modules. In addition, outwardly projecting positioning ribs 54 (FIG. 5) project from opposite ends of the elongated modules for positioning into appropriate grooves (not shown) in the housing at opposite ends of elongated cavity 38.

Figure 6:
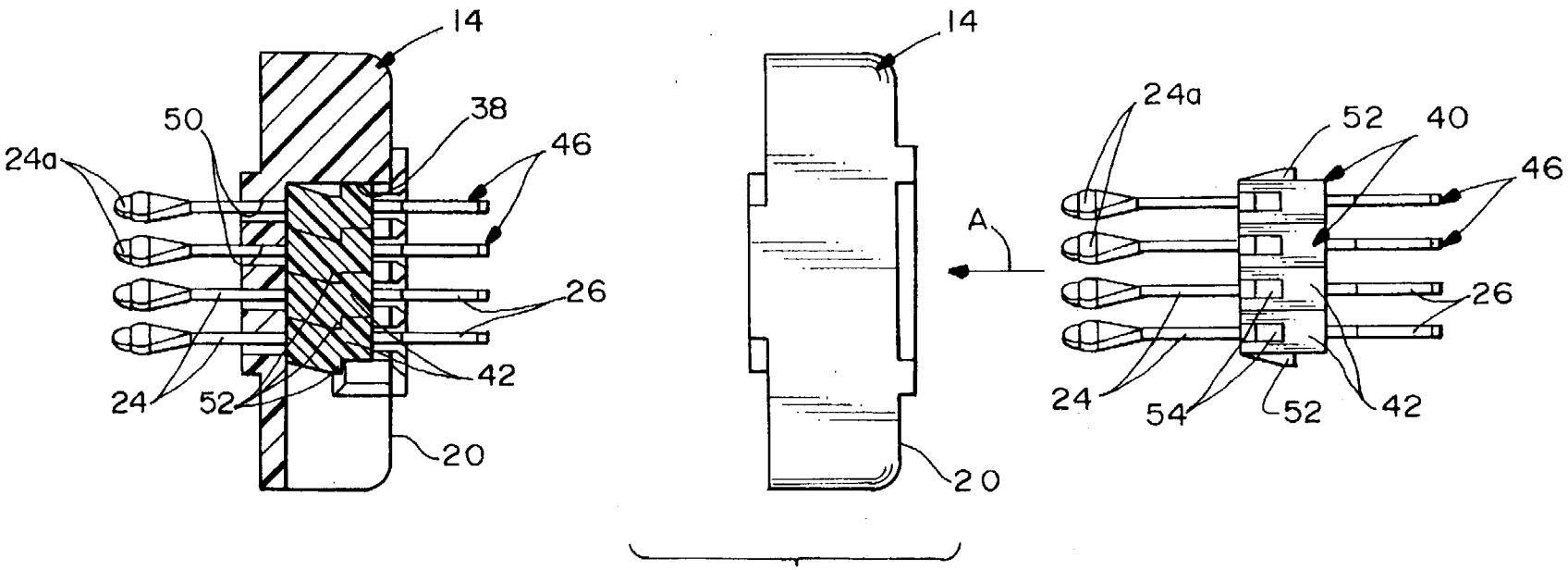
FIG. 6 is a sequential view showing the mounting of a plurality of terminal modules into the connector housing.

FIG. 6 shows a sequential view of assembling a plurality or "cluster" of four terminal modules 40 into connector housing 14. The four modules are shown interengaged by latch projections 52 so that inserts 42 of the modules are in a side-by-side array. The modules then are inserted into housing 14 in the direction of arrow "A". The modules are inserted into cavity 38 in the housing as shown to the left in FIG. 6 which corresponds to the assembled condition of the modules and the housing as shown in and described above in relation to FIG. 4. Again, mating blades or male portions 24 of the terminals project through apertures 50 of the housing, and tail portions 26 of the terminals project rearwardly of rear face 20 of the housing.

Figure 7:
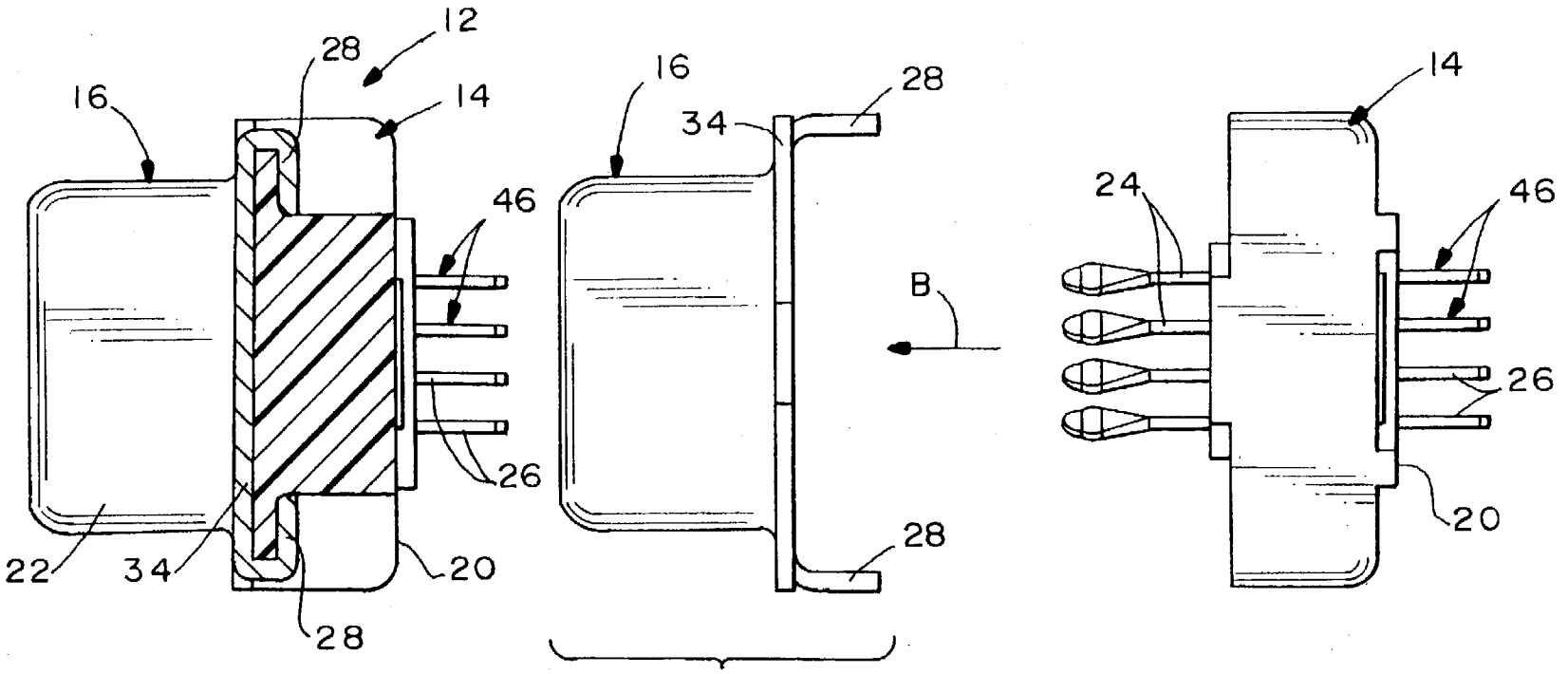
FIG. 7 is a sequential view of mounting the assembly of FIG. 6 into the shell of the connector.

FIG. 7 shows the final step in assembling connector 12, whereby the assembly depicted at the left-hand end of FIG. 6 now is inserted into shield 16 in the direction of arrow "B". Mating male portions 24 of the terminals project into shroud portion 22 of the shield. Tabs 28 of the shield then are bent or formed inwardly as shown to the left in FIG. 7 to clamp the shield to the connector housing.

Although forwardly projecting mating male portions or blades 24 of the terminals are fixed relative to inserts 42 of terminal modules 40, and although the terminal modules are interengaged within cavity 38 of connector housing 14, it is highly desirable to provide some form of auxiliary alignment means to ensure proper spacing and alignment of the mating male portions of the terminals, particularly twisted contact ends **24*a* thereof. The invention herein contemplates the provision of an auxiliary alignment means which is on the connector housing immediately adjacent the terminal-receiving cavity 38**.

Figure 2:
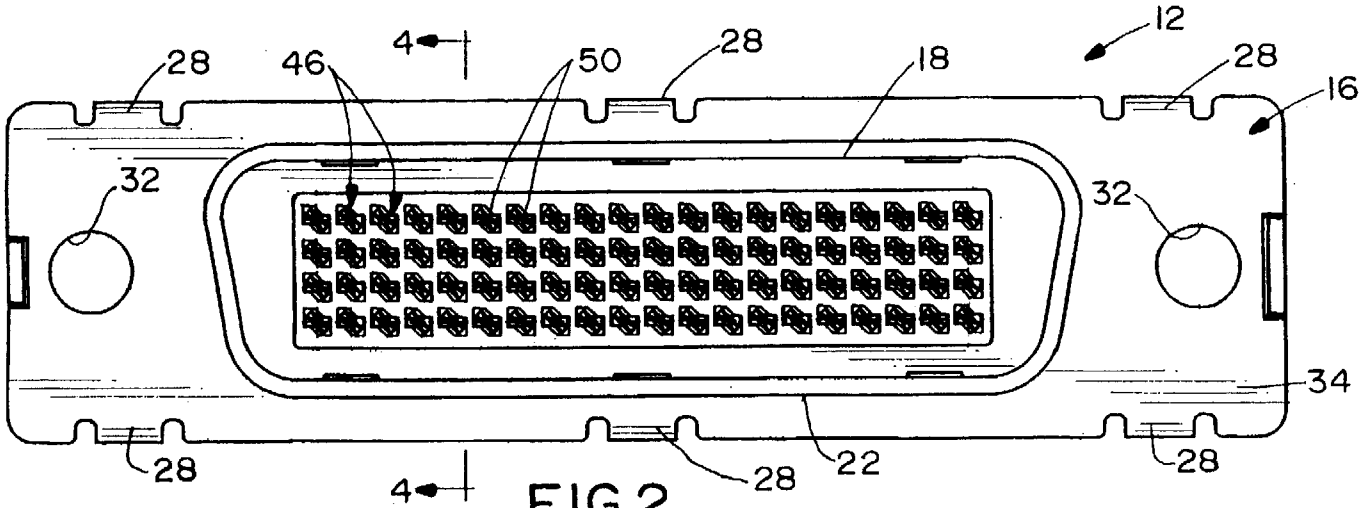
FIG. 2 is a front elevational view of the connector.
Figure 8:
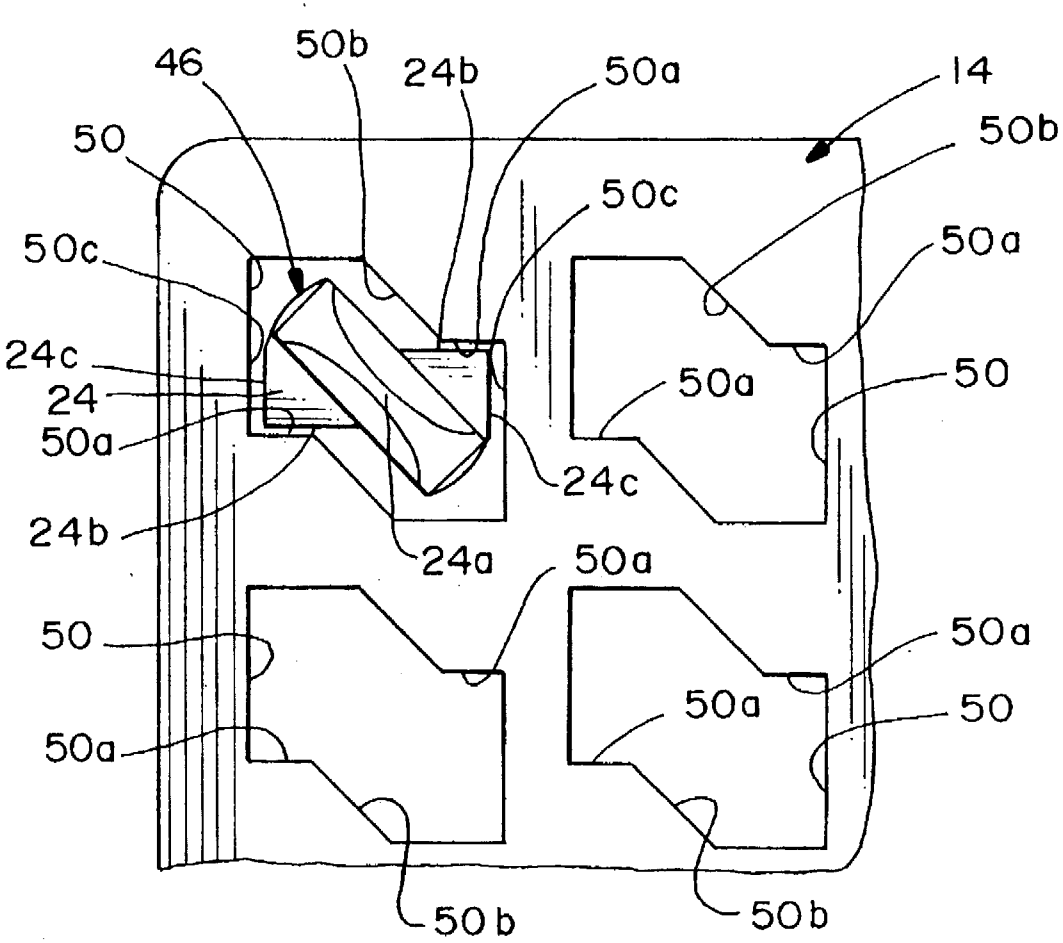
FIG. 8 is a fragmented elevational view showing an enlarged depiction of some of the apertures which form the auxiliary alignment means of the invention.

More particularly, referring to FIG. 8 in conjunction with FIGS. 2 and 4, the auxiliary alignment means of the invention is provided by apertures 50 in connector housing 14 which communicate directly with interior cavity 38. Four such apertures are shown in FIG. 8, with only one of the projecting mating portions 24 of one of the terminals 46 shown in the upper left-hand aperture 50, to facilitate the illustration. As stated above, each forwardly projecting mating male portion 24 of each terminal 46 includes a generally planar, elongated blade. The blade terminates in distal contact end **24*a* that is twisted out of the plane of blade 24 as clearly shown in FIG. 8. In order to allow assembly of the connector as described above in relation to FIG. 6, and in order to provide an auxiliary alignment means for the projecting mating portions of the terminals, apertures 50 are specially configured as shown in FIG. 8**.

In particular, each aperture 50 has opposing side walls **50*a* for embracing a portion 24*b* or opposite sides of terminal blades 24 as shown in the upper right-hand corner of FIG. 8. It should be noted that the depiction in FIG. 8 is greatly enlarged, and, consequently, a slight spacing is shown between side walls 50*a* and blade 24. This spacing is negligible in an actual connector, and the side walls effectively embrace the terminal blade along portions 24*b* thereof to maintain proper spacing and alignment of the mating male portions 24*a* of the terminals of connector 12. In addition, the walls 50*c* may also engage edges 24*c* of the terminal blade 24** to further position and support the blade.

In order to accommodate twisted distal contact ends **24*a* of the terminals during assembly, each aperture 50 includes an oblique portion 50*b* that effectively intersects opposing side walls 50*a* to allow for passage therethrough of twisted distal contact ends 24*a* of blades 24. Yet, once the mating male portions of the terminals are inserted through apertures 50 during assembly, opposing side walls 50*a*** of the apertures are effective to embrace the mating male portions to maintain their proper spacing and alignment.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having a cavity for receiving a plurality of terminal modules;

a plurality of terminal modules each including a dielectric insert receivable in said cavity to define a side-by-side array of modules, each insert being overmolded about a plurality of terminals to rigidly fix the terminals with male portions of the terminals projecting from the housing, the male portion of each terminal including an elongated blade, and the blade terminating in a distal contact end twisted out of the plane of the blade; and auxiliary alignment means on the housing immediately adjacent the cavity for embracing and maintaining proper spacing and alignment of the male portions of the terminals, said auxiliary alignment means comprising apertures in the housing communicating with the cavity, said apertures having opposing side walls embracing and engaging opposite sides of the male portions of respective ones of the terminals and including an oblique portion intersecting said opposing side walls for passage therethrough of said twisted distal contact end of the blade of said terminals.

2. The electrical connector of claim 1 wherein said auxiliary alignment means is integrally formed with the housing.

3. The electrical connector of claim 1 wherein said apertures substantially surround the male portions of the terminals.

4. The electrical connector of claim 1, including complementary interengaging positioning means between the inserts and the housing.

5. The electrical connector of claim 1, including complementary interengaging latch means on each insert of each terminal module for latching the modules in said side-by-side array.

6. An electrical connector, comprising:

a dielectric housing having a cavity for receiving at least one terminal module;

at least one terminal module including a dielectric insert positionable in said cavity, the insert mounting a plurality of terminals having portions projecting from the housing, the protecting portion of each terminal including an elongated blade, and the blade terminating in a distal contact end twisted out of the plane of the blade; and auxiliary alignment means on the housing immediately adjacent the cavity for embracing and maintaining proper spacing and alignment of the projecting portions of the terminals, said auxiliary alignment means comprising apertures in the housing communicating with the cavity, said apertures having opposing side walls embracing and engaging opposite sides of the projecting portions of respective ones of the terminals and including an oblique portion intersecting said opposing side walls for passage therethrough of said twisted distal contact end of the blade of said terminals.

7. An electrical connector, comprising:

a dielectric housing having means for mounting a plurality of terminals;

a plurality of terminals mounted in the housing, each terminal including an elongated blade portion projecting from the housing, the blade portion terminating in a distal contact end twisted out of the plane of the blade portion; and a plurality of passages in the housing through which the blade portions of the terminals project, each passage including opposing side walls for embracing opposite sides of the blade portion of a respective one of the terminals, and each passage including an oblique portion intersecting said opposing side walls for passage therethrough of said twisted distal contact end of the respective terminal.

* * * * *